US011642899B2

(12) United States Patent
Washio

(10) Patent No.: US 11,642,899 B2
(45) Date of Patent: May 9, 2023

(54) RECORDING DEVICE

(71) Applicant: SEIKO EPSON CORPORATION, Tokyo (JP)

(72) Inventor: Yuichi Washio, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/445,242

(22) Filed: Aug. 17, 2021

(65) Prior Publication Data

US 2022/0055381 A1 Feb. 24, 2022

(30) Foreign Application Priority Data

Aug. 19, 2020 (JP) ..... JP2020-138620

(51) Int. Cl.
*B41J 2/01* (2006.01)
*B41J 11/00* (2006.01)

(52) U.S. Cl.
CPC ..... *B41J 11/0085* (2013.01); *B41J 11/007* (2013.01)

(58) Field of Classification Search
None
See application file for complete search history.

(56) References Cited

U.S. PATENT DOCUMENTS

2010/0214343 A1* 8/2010 Yamaguchi ..... B41J 11/0025 347/104
2011/0109693 A1* 5/2011 Ohnishi ..... B41J 29/02 347/34

FOREIGN PATENT DOCUMENTS

JP 2005-161758 A 6/2005
JP 2005271316 A * 10/2005 ..... B41J 2/165
JP 2016118343 A * 6/2016

* cited by examiner

*Primary Examiner* — Erica S Lin
*Assistant Examiner* — Tracey M McMillion
(74) *Attorney, Agent, or Firm* — Workman Nydegger

(57) ABSTRACT

A printer includes a recording unit, a glue belt, a feeding unit, a suction unit, and a duct unit. The recording unit performs recording on a medium. The glue belt includes a support face capable of supporting the medium. The feeding unit feeds air toward the support face. The suction unit sucks air flowing from the support face. Air discharged from the suction unit flows through the duct unit. The duct unit is provided with an opening portion that adjusts a pressure difference between a pressure inside the duct unit and a pressure outside the duct unit.

7 Claims, 9 Drawing Sheets

RECORDING DEVICE

The present application is based on, and claims priority from JP Application Serial Number 2020-138620, filed Aug. 19, 2020, the disclosure of which is hereby incorporated by reference herein in its entirety.

BACKGROUND

1. Technical Field

The present disclosure relates to a recording device.

2. Related Art

An inkjet recording device disclosed in JP-A-2005-161758 is provided with an air blowing mechanism including a discharge fan that discharges air in a direction in which the air is blown with respect to an ink discharge unit of a recording head, and an air recovery mechanism including a recovery fan that sucks the air in a direction in which the air is received with respect to the ink discharge unit of the recording head.

The inkjet recording device disclosed in JP-A-2005-161758 is installed in an installation location including exhaust equipment, and the air recovery mechanism may be connected to the exhaust equipment via a duct. An exhaust capacity of the exhaust equipment is already determined at the installation location of the inkjet recording device, and the inkjet recording device cannot control the exhaust capacity of the exhaust equipment.

Here, when the exhaust capacity of the exhaust equipment is greater than an exhaust capacity of the recovery fan, there is a risk that an air flow inside the device created by the recovery fan may be disturbed by the discharge of air by the exhaust equipment.

SUMMARY

In order to solve the above-described problem, a recording device according to the present disclosure includes a recording unit configured to perform recording on a medium transported in a transport direction, a support unit facing the recording unit and including a support face configured to support the medium, a feeding unit provided upstream of the recording unit in the transport direction and configured to feed gas toward the support face, a suction unit provided downstream of the recording unit in the transport direction and configured to suck gas flowing from the support face, and a duct unit through which gas discharged from the suction unit flows. A pressure difference adjustment unit is provided in the duct unit, the pressure difference adjustment unit being configured to adjust a pressure difference between a pressure inside the duct unit and a pressure outside the duct unit.

DESCRIPTION OF EXEMPLARY EMBODIMENTS

Figure 1:
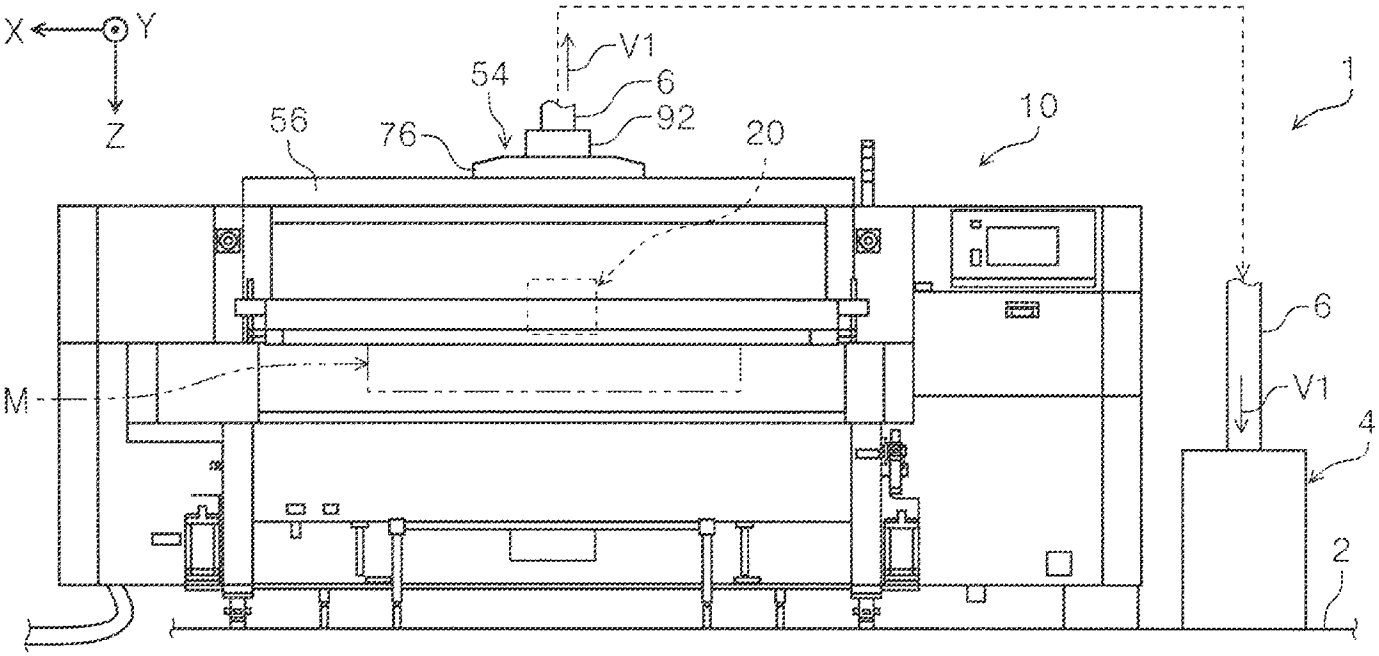
FIG. 1 is a front view of a printer according to a first embodiment.

Hereinafter, the present disclosure will be described in overview.

A recording device according to a first aspect of the present disclosure for solving the above-described problem includes a recording unit configured to perform recording on a medium transported in a transport direction, a support unit facing the recording unit and including a support face configured to support the medium, a feeding unit provided upstream of the recording unit in the transport direction and configured to feed gas toward the support face, a suction unit provided downstream of the recording unit in the transport direction and configured to suck gas flowing from the support face, and a duct unit through which gas discharged from the suction unit flows. A pressure difference adjustment unit is provided in the duct unit, the pressure difference adjustment unit being configured to adjust a pressure difference between a pressure inside the duct unit and a pressure outside the duct unit.

An end of the duct unit through which gas discharged from the suction unit flows is coupled to exhaust equipment of a factory in which the recording device is installed, for example.

According to the present aspect, for example, when an exhaust capacity of the exhaust equipment is greater than an exhaust capacity of the suction unit provided in the recording device, the pressure inside the duct unit is lower than the pressure outside the duct unit.

Here, since the pressure difference between the pressure inside the duct unit and the pressure outside the duct unit is adjusted using the pressure difference adjustment unit, it is possible to reduce the pressure difference. Thus, even when the exhaust capacity of the exhaust equipment is greater than the exhaust capacity of the suction unit provided in the recording device, it is possible to suppress an air flow in the periphery of the recording unit and an air flow inside the suction unit from being disturbed by the discharge of air by the exhaust equipment.

With respect to the first aspect, the recording device according to a second aspect is a hole portion provided at a side portion of the duct unit.

According to the present aspect, since it is sufficient only that the hole portion be provided at the side portion of the duct unit, the pressure difference adjustment unit can be realized using a simple configuration, compared to a configuration in which a unit that adjusts the pressure difference is attached to the duct unit.

With respect to the second aspect, in the recording device according to a third aspect, the pressure difference adjustment unit includes a pipe coupled to the hole portion, the pipe being communicable with the inside of the duct unit and the outside of the duct unit, and a valve provided at the pipe, the valve being configured to adjust a flow rate of gas flowing inside the pipe.

According to the present aspect, by adjusting the flow rate of the gas flowing inside the pipe in accordance with a degree of opening of the valve, it is possible to reduce the pressure difference between the pressure inside the duct and the pressure outside the duct. In this way, the pressure difference can be changed in accordance with the capacity of the exhaust equipment at an installation location of the recording device.

With respect to the second aspect or the third aspect, in a recording device according to a fourth aspect, the duct unit includes a first duct into which gas flows from the suction unit, and a second duct positioned upstream of the first duct in a gravitational direction, and coupled to the first duct. As seen from the gravitational direction, an inner wall surface of the second duct is positioned further to the outside than an outer wall surface of the first duct. As seen from the gravitational direction, the hole portion is a gap between the inner wall surface and the outer wall surface. According to the present aspect, the gap between the inner wall surface and the outer wall surface functions as the hole portion. Here, since the second duct covers the first duct from upstream in the gravitational direction, even if dust falls in the gravitational direction from a ceiling of the installation location of the recording device, the dust can be prevented from entering the first duct and the second duct through the hole portion.

With respect to the fourth aspect, in a recording device according to a fifth aspect, an upper wall, to which the second duct is attached, is provided at an upstream end portion, in the gravitational direction, of the first duct. A ventilation hole is formed at the upper wall, the ventilation hole extending through the upper wall in the gravitational direction, and gas being flowable through the ventilation hole. A peripheral edge portion of the ventilation hole at the upper wall is inclined with respect to a horizontal direction orthogonal to the gravitational direction.

According to the present aspect, compared to a configuration in which the peripheral edge portion of the ventilation hole at the upper wall is along the horizontal direction, the gas can easily flow in the direction in which the upper wall is inclined. Thus, the gas can be suppressed from stagnating in a part of the suction unit.

With respect to the fourth aspect or the fifth aspect, a recording device according to a sixth aspect includes a third duct positioned upstream, in the gravitational direction, of the second duct and coupled to the second duct. A filter is detachably provided at the third duct, gas inside the third duct being permeable through the filter.

Foreign material may be included in the gas discharged from the suction unit.

According to the present aspect, the foreign material in the gas can be recovered by the filter, and the filter that is contaminated by the foreign material can be easily replaced.

With respect to any one of the first aspect to the sixth aspect, in a recording device according to a seventh aspect, the suction unit includes a circulation portion extending from a position between the recording unit and the support face to the duct unit, gas being flowable through the inside of the circulation portion, and a suction fan provided inside the duct unit and configured to suck gas. The duct unit includes a partition wall extending to the interior of the circulation portion and configured to partition a part of the circulation portion between the recording unit and the suction fan.

According to the present aspect, a part of the circulation portion is partitioned, between the recording unit and the suction fan, by the partition wall. Here, when a part of the gas that has not been sucked into the suction fan stagnates and flows toward the recording unit, the partition wall restricts the flow of this part of the gas. In this way, the gas that has flowed downstream from a space between the recording unit and the support face can be suppressed from once more flowing into the space and contaminating the medium.

With respect to the seventh aspect, in the recording device according to an eighth aspect, a part of the partition wall is inclined with respect to the horizontal direction orthogonal to the gravitational direction.

According to the present aspect, compared to a configuration in which a part of the partition wall is along the horizontal direction, the gas can easily flow in a direction in which the part of the partition wall is inclined. Thus, the gas can be suppressed from stagnating in a part of the suction unit.

First Embodiment

Hereinafter, a printer 10 according to a first embodiment, which is an example of a recording device according to the present disclosure, will be specifically described.

FIG. 1 illustrates an overall configuration of the printer 10 installed on a floor 2 of a factory 1, which is an example of a installation location. The printer 10 performs recording on a medium M. Examples of the medium M include fabric and a sheet. Note that an X-Y-Z coordinate system illustrated in each of the drawings is an orthogonal coordinate system.

An X direction is a device width direction of the printer 10, and, as an example, is a horizontal direction orthogonal to a gravitational direction to be described below. When the printer 10 is viewed from the front, a direction toward the left in the X direction is a positive X direction, and a direction toward the right is a negative X direction. Further, the X direction is an example of a width direction of the medium M.

A Y direction is an example of a transport direction of the medium M and of a depth direction of the printer 10, and is a horizontal direction. Here, the transport direction in which the medium M is transported is a positive Y direction, and the direction opposite to the positive Y direction is a negative Y direction.

A Z direction is an example of a device height direction of the printer 10. Here, the gravitational direction in which gravity acts on the printer 10 is a positive Z direction. Also note that a negative Z direction is the direction opposite to the gravitational direction.

An exhaust device 4, which is an example of exhaust equipment, is installed on the floor 2. Note that the exhaust device 4 may be provided at a ceiling portion (not illustrated) of the factory 1.

The exhaust device 4 is provided with an exhaust fan (not illustrated), and is coupled to a third duct 92, to be described below, of the printer 10, via an exhaust duct 6. Air discharge from the printer 10 is recovered by the exhaust device 4, is cleaned, and then discharged from the exhaust device 4 to the outside of the factory 1. Here, an amount of air generated as a result of the exhaust fan of the exhaust device 4 being rotated, that is, a flow rate of the air, is assumed to be V1 ($m^3$/sec). The air is an example of a gas.

In this way, in the printer 10, an end of a duct unit 54, to be described later, is coupled to the exhaust device 4 via the exhaust duct 6.

Figure 2:
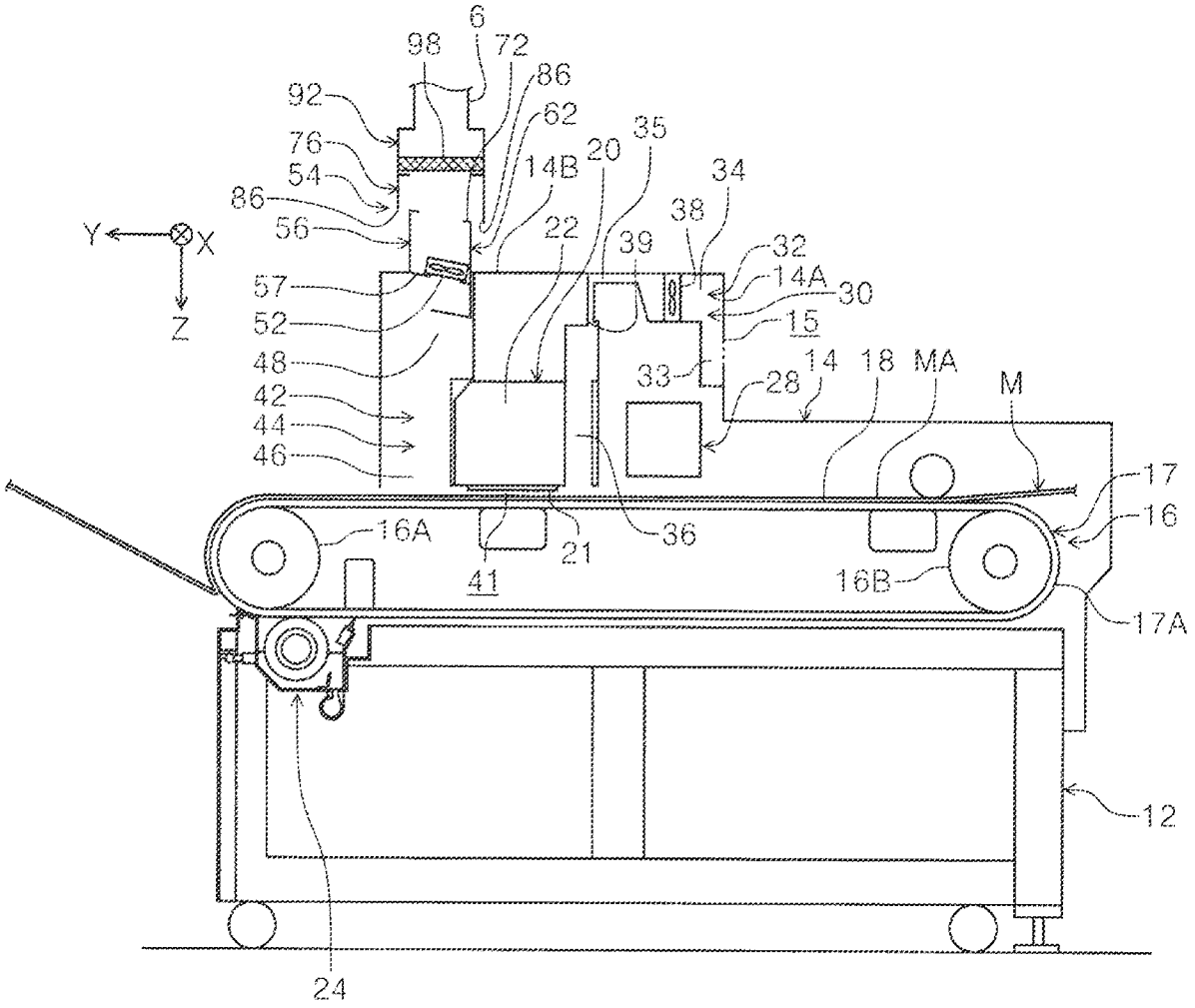
FIG. 2 is a schematic diagram illustrating an internal structure of the printer according to the first embodiment.

As illustrated in FIG. 2, the printer 10 includes, for example, a main body frame 12, a main body cover 14, a transport unit 16, a recording unit 20, a cleaning unit 26, a control unit 28, and a flow path 30.

Specifically, as main units, the printer 10 is provided with the recording unit 20, a glue belt 17, a feeding unit 32, a suction unit 42, a duct unit 54, and opening portions 86, to be described later.

The main body frame 12 is configured as a base unit on which each of the units of the printer 10 are provided.

The main body cover 14 is an outer member that covers each of the units of the printer 10. In the main body cover 14, a section further in the positive Y direction than a center thereof in the Y direction protrudes in the negative Z direction. Of sections configuring the main body cover 14, a wall portion in the negative Y direction is referred to as a side wall 14A, and a wall portion in the negative Z direction is referred to as an upper wall portion 14B. A plurality of inflow ports 15 are formed in the side wall 14A that allow air to flow from the outside of the side wall 14A to the interior of the main body cover 14.

The transport unit 16 includes a driving roller 16A, a driven roller 16B, the glue belt 17, and a winding roller (not illustrated). Then, the transport unit 16 can transport the medium M in the positive Y direction, in accordance with the movement of the glue belt 17 caused by the rotation of the driving roller 16A. In the positive Y direction, the driving roller 16A is disposed downstream and the driven roller 16B is disposed upstream. Further, both the driving roller 16A and the driven roller 16B have a rotation axis along the X direction. The rotation of the driving roller 16A is controlled by the control unit 28 to be described below.

The glue belt 17 is an example of a support unit, and is configured as an endless belt formed by bonding together both ends of an elastic flat plate. Further, the glue belt 17 is wound over the outer circumferential surface of the driving roller 16A and the outer circumferential surface of the driven roller 16B, and can move in a revolving manner.

For example, an outer circumferential surface 17A of the glue belt 17 has tackiness and is able to support and suck the medium M. The tackiness refers to a property of being able to temporarily adhere to another member, and being able to be peeled from an adhering state.

A flat portion of the outer circumferential surface 17A positioned between the driving roller 16A and the driven roller 16B in the negative Z direction is a support face 18. In other words, the glue belt 17 includes the support face 18. A portion of the support face 18 faces the recording unit 20, to be described later, in the Z direction. Further, the support face 18 can support the medium M. In other words, the printer 10 according to the embodiment is an inkjet type printer.

The recording unit 20 is an example of a recording unit, and can perform recording on the medium M transported in the positive Y direction. Specifically, the recording unit 20 includes a recording head 21, which is an example of a discharge unit, and a carriage 22 that supports the recording head 21 such that the recording head 21 can reciprocate in the X direction. Further, the recording unit 20 is disposed above (in the negative Z direction) with respect to the glue belt 17.

The recording head 21 includes a plurality of nozzles (not illustrated) and is disposed in the negative Z direction with respect to the support face 18. Air can flow through a space 41 between the recording head 21 and the support face 18 or the medium M. In other words, the space 41 configures a part of a flow path through which air flows.

Further, the recording head 21 can perform the recording on the medium M by discharging ink, which is an example of droplets, from the plurality of nozzles onto a recording surface MA of the medium M.

The cleaning unit 26 is positioned downstream of the driving roller 16A in a direction in which the glue belt 17 revolves, and cleans the outer circumferential surface 17A.

The control unit 28 includes a central processing unit (CPU), a read only memory (ROM), a random access memory (RAM), and storage (all not illustrated), and controls operations of each of the units of the printer 10.

Of a space inside the printer 10, the flow path 30 is a section that includes the space 41 described above and functions as a flow path through which air is forcibly caused to flow. Further, for example, the flow path 30 includes the feeding unit 32, the suction unit 42, the duct unit 54, and the opening portions 86.

The feeding unit 32 is provided upstream of the recording unit 20 in the positive Y direction, and feeds air toward the support face 18. Specifically, for example, the feeding unit 32 includes a first flow path forming portion 33, a second flow path forming portion 34, a third flow path forming portion 35, and a fourth flow path forming portion 36. Each of the first flow path forming section 33, the second flow path forming section 34, the third flow path forming section 35, and the fourth flow path forming section 36 is formed in a cylindrical shape by members (not illustrated), each configuring the interior of the printer 10, and by the main body cover 14.

The first flow path forming portion 33 communicates with the outside of the printer 10 via an inlet 15, and extends from the inlet 15 in the negative Z direction.

The second flow path forming portion 34 extends in the positive Y direction from an end portion, in the negative Z direction, of the first flow path forming portion 33. Further, a first fan 38 is provided inside the second flow path forming portion 34.

The first fan 38 is rotated by a motor (not illustrated) to take in air from the first flow path forming portion 33 toward the second flow path forming portion 34, and discharge the air from the second flow path forming portion 34 toward the third flow path forming portion 35.

The third flow path forming portion 35 is bent in an L shape as viewed in the X direction, and includes a section extending from the second flow path forming portion 34 in the positive Y direction, and a section extending in the positive Z direction from an end portion thereof in the positive Y direction. Note that, for example, a flow path cross-sectional area of the third flow path forming portion 35 is smaller than a flow path cross-sectional area of the second flow path forming portion 34. The flow path cross-sectional area is an area of the flow path in a plane orthogonal to a direction in which air flows. Further, an outlet 39 through which the air is blown in the positive Z direction toward the fourth flow path forming portion 36 is formed at section forming a terminal end of the third flow path forming portion 35.

The fourth flow path forming portion 36 extends from the outlet 39 in the positive Z direction. Further, the dimension in the X direction of the fourth flow path forming portion 36 is substantially the same size as the dimension in the X direction of the glue belt 17. In other words, the fourth flow path forming portion 36 is long in the X direction. An end portion in the positive Z direction of the fourth flow path forming portion 36 is connected to the space 41.

In this way, the feeding unit 32 is capable of feeding the air flowing in from the inlet 15 into the space 41.

Note that, in principle, the space 41 refers to a space between the recording head 21 and the support face 18. Here, the recording head 21 reciprocates along the X direction. Thus, the space 41 also includes a space between a movement region in the X direction of the recording head 21 and the support face 18.

The suction unit 42 is provided downstream of the recording unit 20 in the positive Y direction, and sucks air flowing from the support face 18. Specifically, the suction unit 42 includes a circulation portion 44 and a second fan 52.

The circulation portion 44 extends from the space 41 to the first duct 56 to be described later, and the air can circulate inside the circulation portion 44. Further, for example, the circulation portion 44 includes a fifth flow path forming portion 46 and a sixth flow path forming portion 48. The fifth flow path forming portion 46 and the sixth flow path forming portion 48 are formed in a cylindrical shape by members (not illustrated), each configuring the interior of the printer 10, and by the main body cover 14.

The fifth flow path forming portion 46 extends in the negative Z direction from a section in the positive Y direction with respect to the space 41. Further, the dimension in the X direction of the fifth flow path forming portion 46 is substantially the same size as the dimension in the X direction of the glue belt 17. An end portion of the fifth flow path forming portion 46 in the positive Z direction is connected to the space 41. In other words, the air flowing through the interior of the space 41 is fed into the fifth flow path forming portion 46.

The sixth flow path forming portion 48 extends in the negative Z direction from an end portion in the negative Z direction of the fifth flow path forming portion 46. Further, the dimension in the X direction of the sixth flow path forming portion 48 is substantially the same size as the dimension in the X direction of the glue belt 17. For example, the flow path cross-sectional area of the sixth flow path forming portion 48 is greater than the flow path cross-sectional area of the fifth flow path forming portion 46. An end portion of the sixth flow path forming portion 48 in the negative Z direction is connected to the first duct 56 to be described later.

The second fan 52 is an example of a suction fan, and is provided inside the first duct 56 to be described later. Further, the second fan 52 sucks air from the fifth flow path forming portion 46 and the sixth flow path forming portion 48. Then, the air sucked by the second fan 52 is discharged into the interior of the first duct 56.

In this way, the suction unit 42 sucks the air flowing from the space 41, and discharges the air to the first duct 56.

The duct unit 54 includes, for example, the first duct 56, a second duct 76, and the third duct 92. The air discharged from the suction unit 42 flows inside the duct unit 54. Note that the air flowing inside the suction unit 42 and the duct unit 54 is very likely to include ink mist, which is a part of the ink discharged from the recording head 21, dust inside the printer 10, and the like.

The first duct 56 is fixed to the upper wall portion 14B using bolts (not illustrated). The air from the suction unit 42 flows into the first duct 56. Specifically, the first duct 56 is formed in a hollow box shape including a bottom wall 57, side walls 62, and an upper wall 72.

The bottom wall 57 slopes obliquely downward as viewed from the X direction. In other words, the bottom wall 57 is inclined relative to the Y direction as viewed from the X direction. An end portion of the bottom wall 57 in the negative Y direction is positioned further in the positive Z direction than an end portion of the base wall 57 in the positive Y direction. Further, the bottom wall 57 extends in the X direction, and the dimension in the X direction thereof is substantially the same size as the dimension in the X direction of the glue belt 17.

Figure 3:
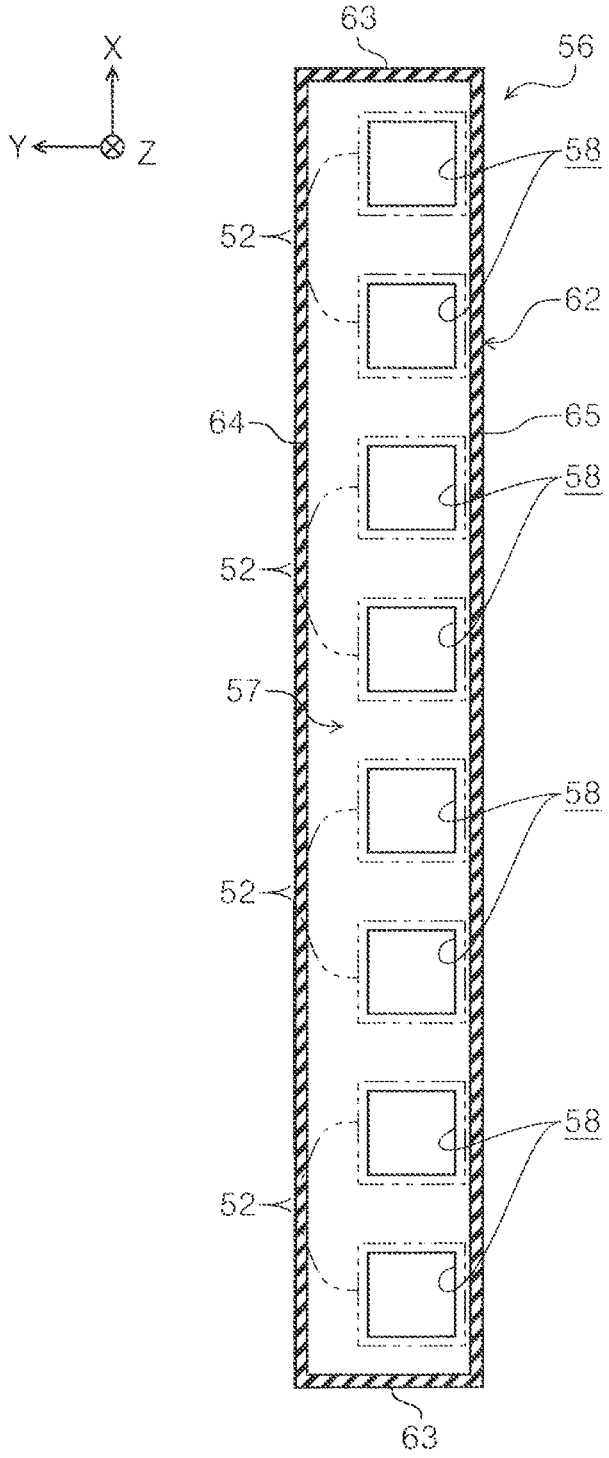
FIG. 3 is a plan view illustrating a bottom surface of a first duct according to the first embodiment.

As illustrated in FIG. 3, eight through holes 58 are formed in the bottom wall 57, for example. The eight through holes 58 are disposed while being spaced apart in the X direction, and penetrate the bottom wall 57 in the Z direction. Each of the through holes 58 is formed in a square shape having a set of sides along the X direction and a set of sides along the Y direction, as viewed from the Z direction. The center (not illustrated) of each of the through holes 58 is positioned in the negative Y direction with respect to the center in the Y direction of the bottom wall 57. In other words, for example, each of the through holes 58 is disposed to be biased toward the end portion in the negative Y direction of the bottom wall 57.

The side walls 62 are provided in the negative Z direction from both ends in the X direction and both end portions in the Y direction of the bottom wall 57, except for a portion of a third side wall 65 to be described below. Specifically, the side walls 62 include a pair of first side walls 63 facing each other in the X direction, a second side wall 64 connecting, in the X direction, end portions in the positive Y direction of the pair of first side walls 63, and a third side wall 65 connecting, in the X direction, end portions in the negative Y direction of the pair of first side walls 63.

Of an end face, in the negative Z direction, of the first side wall 63, an end thereof in the negative Y direction is positioned further in the positive Z direction than an end thereof in the positive Y direction, namely, the end face is inclined obliquely downward. In other words, the end face in the negative Z direction of the first side wall 63 is inclined with respect to the Y direction as viewed from the X direction. An end face of the third side wall 65 in the positive Z direction is positioned further in the positive Z direction than an end face of the second side wall 64 in the positive Z direction. An end face of the third side wall 65 in the negative Z direction is positioned further in the positive Z direction than an end face in the negative Z direction of the second side wall 64.

Figure 7:
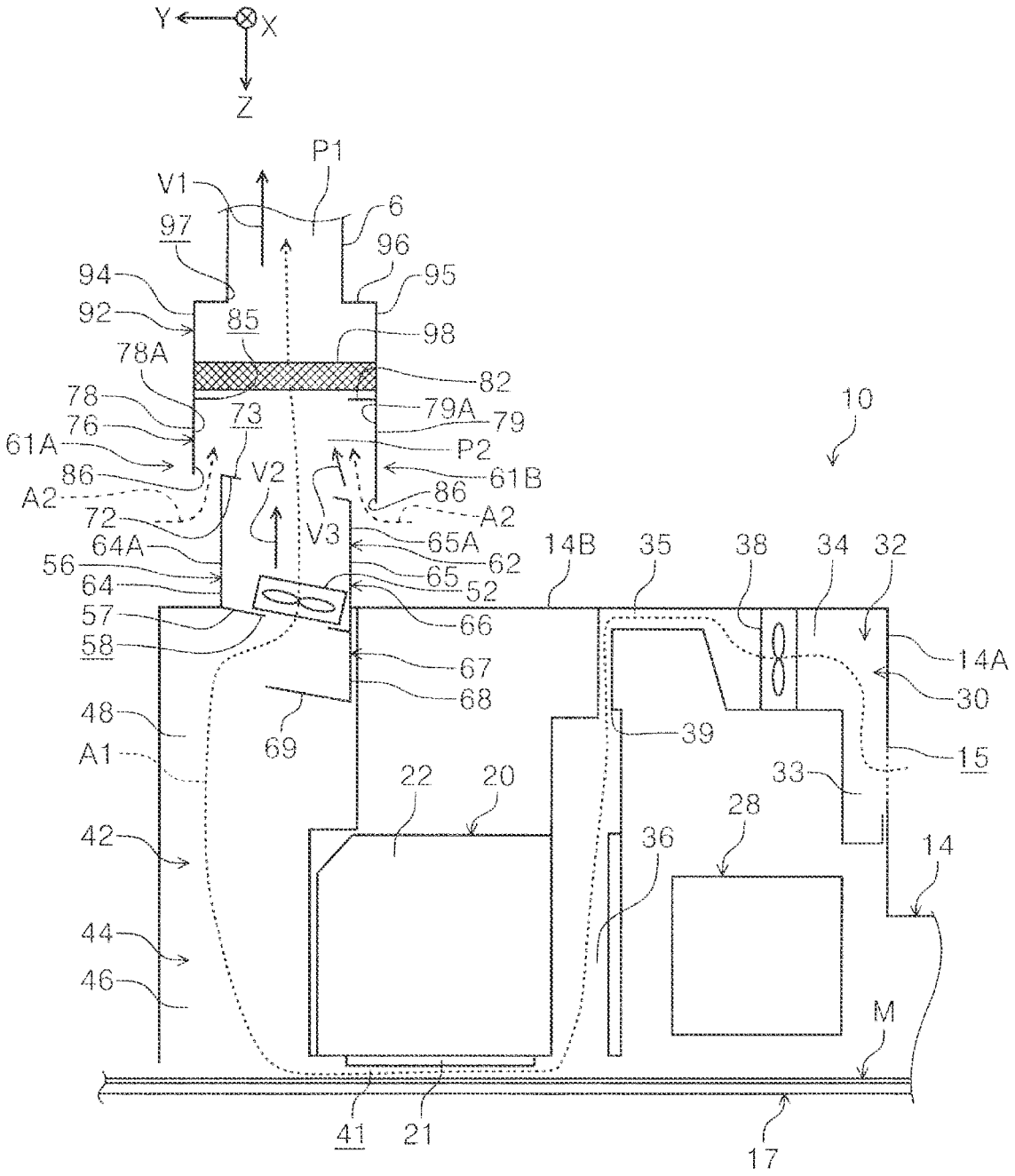
FIG. 7 is a schematic diagram illustrating a state in which a gas flows in the printer according to the first embodiment.

As illustrated in FIG. 7, the end portion of the bottom wall 57 in the positive Y direction connects to a part of the top wall 14B. The second side wall 64 stands upright in the negative Z direction from a part of the top wall 14B.

The third side wall 65 is an example of a partition wall The third side wall 65 extends into the interior of, and partitions a part of, the circulation portion 44, between the recording unit 20 and the second fan 52. Specifically, the third side wall 65 includes an upper portion 66 that stands upright in the negative Z direction from the end portion in the negative Y direction of the bottom wall 57, and a lower portion 67 that extends in the positive Z direction from the end portion in the negative Y direction of the bottom wall 57. A part of the upper portion 66 is connected to the top wall 14B.

A side surface in the positive Y direction of the second side wall 64 is referred to as an outer wall surface 64A. A side surface in the negative Y direction of the third side wall 65 is referred to as an outer wall surface 65A.

Note that in FIG. 7, the main flow of the air from the interior of the printer 10 toward the exhaust duct 6 is indicated by a dashed line arrow A1, and the flow of the air flowing into the duct unit 54 via the opening portion 86 is indicated by a dashed line arrow A2.

The lower portion 67 includes a vertical wall 68 along the X-Z plane and an inclined wall 69 extending obliquely upward from an end portion in the positive Z direction of the vertical wall 68. The vertical wall 68 and the inclined wall 69 are positioned inside the sixth flow path forming portion 48.

The inclined wall 69 is inclined in an intersecting direction intersecting the Y direction as viewed from the X direction. An end portion in the positive Y direction of the inclined wall 69 is positioned further in the negative Z direction than an end portion in the positive Y direction thereof. That is, a part of the first side wall 63 is inclined with respect to the Y direction that is orthogonal to the positive Z direction. Further, the inclined wall 69 extends to a position where the end portion in the positive Y direction thereof covers the through hole 58 as viewed from the positive Z direction. In this way, the inclined wall 69 partitions a part of a space of the sixth flow path forming portion 48 into a space close to the recording unit 20 and a space close to the first duct 56.

The upper wall 72 is provided at a downstream end portion of the first duct 56 in the negative Z direction. Further, the upper wall 72 also covers the bottom wall 57 and the side wall 62 from the negative Z direction, except for a part of the bottom wall 57. Furthermore, the upper wall 72 is inclined obliquely downward as viewed from the X direction, and an end portion in the negative Y direction thereof is positioned further in the positive Z direction than an end portion in the positive Y direction thereof. Further, the upper wall 72 extends in the X direction, and the dimension in the X direction thereof is substantially the same size as the dimension in the X direction of the glue belt 17. The second duct 76, to be described later, is attached to the upper wall 72.

Figure 4:
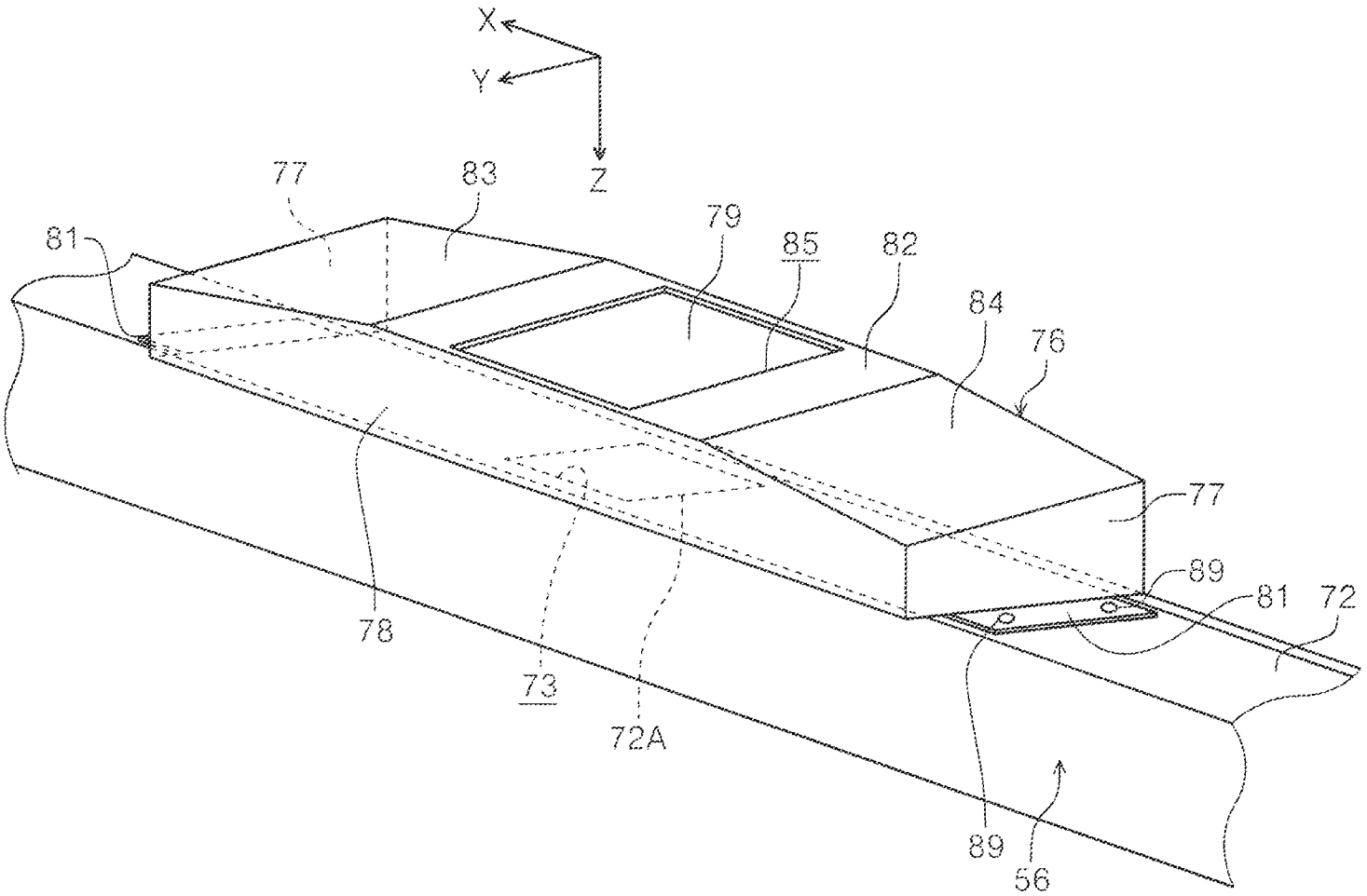
FIG. 4 is a perspective view illustrating the first duct and a second duct according to the first embodiment.

The first duct 56 and the second duct 76 are illustrated in FIG. 4. One ventilation hole 73, which penetrates the upper wall 72 in the positive Z direction, is formed in a central portion in the X direction of the upper wall 72, for example. The ventilation hole 73 is formed in a square shape having a pair of sides along the X direction and a pair of sides along the Y direction. The center of the ventilation hole 73 in the Y direction is positioned in the center, in the Y direction, in the upper wall 72. An opening area of the ventilation hole 73 is larger than an opening area of one of the through holes 58 (FIG. 3). In this way, the ventilation hole 73 is formed in the upper wall 72 so that the air can flow therethrough. A peripheral edge portion 72A of the ventilation hole 73 in the upper wall 72 is inclined in a direction intersecting the Y direction as viewed from the X direction. In other words, the peripheral edge portion 72A of the ventilation hole 73 in the upper wall 72 is inclined with respect to the Y direction that is orthogonal to the positive Z direction.

The second duct 76 is positioned downstream of the first duct 56 in the negative Z direction. In other words, the second duct 76 is positioned upstream of the first duct 56 in the positive Z direction. Further, the second duct 76 is coupled to the first duct 56. Specifically, the second duct 76 includes a pair of opposing walls 77 facing each other in the X direction, a first vertical wall 78 and a second vertical wall 79 facing each other in the Y direction, and a top wall 82 and inclined walls 83 and 84 that form a ceiling portion of the second duct 76.

End faces of the opposing walls 77 in the positive Z direction are inclined along the upper wall 72. Both end portions in the Y direction of the opposing walls 77 stand upright in the negative Z direction. End faces in the negative Z direction of the opposing walls 77 extend along the Y direction. Plate portions 81 that protrude toward the outside in the X direction are formed on end portions, in the positive Z direction, of the opposing walls 77. The plate portions 81 are attached to the upper wall 72 by bolts 89. Further, the dimension of the opposing wall 77 in the Y direction is greater than the dimension of the first duct 56 in the Y direction.

As illustrated in FIG. 7, the first vertical wall 78 connects, in the X direction, end portions of the pair of opposing walls 77 (FIG. 4) in the positive Y direction. A side surface in the negative Y direction of the first vertical wall 78 is an inner wall surface 78A. Further, the first vertical wall 78 and the second side wall 64 are collectively referred to as a side portion 61A.

The second vertical wall 79 connects, in the X direction, end portions in the negative Y direction of the pair of opposing walls 77. A side surface in the positive Y direction of the second vertical wall 79 is an inner wall surface 79A. Further, the second vertical wall 79 and the third side wall 65 are collectively referred to as a side portion 61B.

As illustrated in FIG. 4, the top wall 82 connects, in the Y direction, the center in the X direction of the first vertical wall 78 and the center in the X direction of the second vertical wall 79. Further, the top wall 82 is formed in a plate shape having a predetermined thickness in the Z direction. One ventilation hole 85, which penetrates the top wall 82 in the positive Z direction, is formed in the top wall 82.

The ventilation hole 85 is formed in a square shape having a pair of sides along the X direction and a pair of sides along the Y direction. The center of the ventilation hole 85 in the Y direction is positioned in the center, in the Y direction, in the top wall 82. The ventilation hole 85 is aligned in the Z direction with the ventilation hole 73. An opening area of the ventilation hole 85 is larger than the opening area of the ventilation hole 73. In this way, the ventilation hole 85 is formed in the top wall 82 so that the air can flow therethrough.

The inclined wall 83 is inclined from an end portion in the positive X direction of the top wall 82 toward the end portion in the negative Z direction of the opposing wall 77 in the positive X direction. The inclined wall 84 is inclined from an end portion in the negative X direction of the top wall 82 toward the end portion in the negative Z direction of the opposing wall 77 in the negative X direction.

Figure 5:
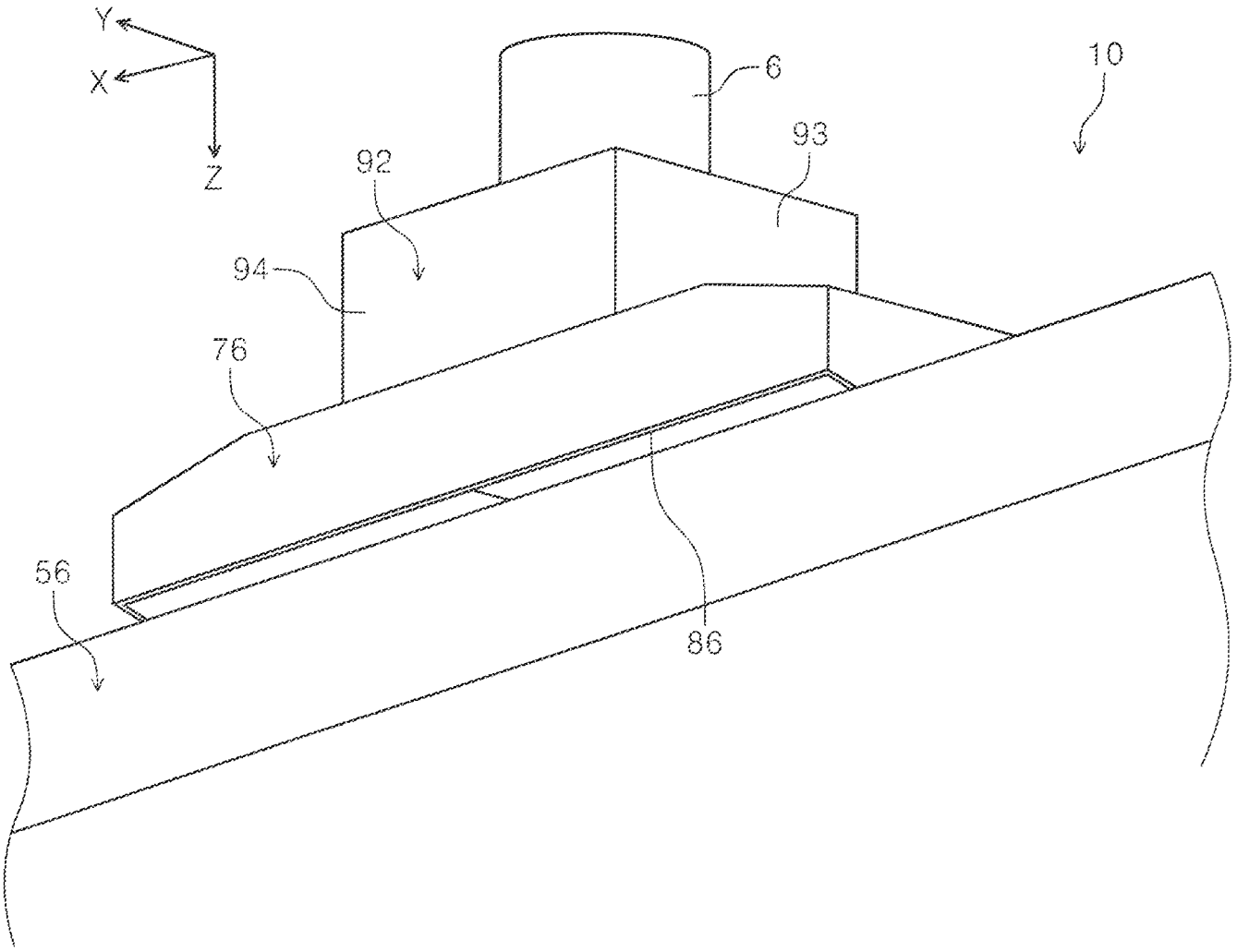
FIG. 5 is a perspective view illustrating a section from the first duct according to the first embodiment to an exhaust duct of a factory.

As illustrated in FIG. 5 and FIG. 7, the third duct 92 is positioned upstream of the second duct 76 in the positive Z direction and is coupled to the second duct 76. Specifically, the third duct 92 includes a pair of vertical walls 93 facing each other in the X direction, a vertical wall 94 and a vertical wall 95 facing each other in the Y direction, and a top wall 96 configuring an end portion of the third duct 92 in the negative Z direction. Note that the vertical wall 93 in the positive X direction is not illustrated.

The vertical wall 94 is disposed downstream of the vertical wall 95 in the positive Y direction. Further, the vertical wall 94 is attached to the pair of vertical walls 93 using screws (not illustrated). Note that the vertical wall 94 can be removed from the pair of vertical walls 93 by removing the screws. In other words, the vertical wall 94 is detachably provided on the pair of vertical walls 93.

The top wall 96 covers, from the negative Z direction, a space enclosed by the pair of vertical walls 93, the vertical wall 94, and the vertical wall 95. One ventilation hole 97, which penetrates the top wall 96 in the positive Z direction, is formed in the top wall 96. The ventilation hole 97 is formed in a circular shape as viewed from the Z direction. The center of the ventilation hole 97 is positioned in the center in the top wall 96. An opening area of the ventilation hole 97 is smaller than an opening area of the exhaust duct 6. In this way, the ventilation hole 97 is formed in the top wall 96 so that the air can flow therethrough.

As illustrated in FIG. 7, a filter 98 is provided inside the third duct 92. The filter 98 is mounted in the third duct 92 by attaching the vertical wall 94 to the pair of vertical walls 93 (FIG. 5) in a state of being disposed inside the third duct 92. Further, the filter 98 can be detached from the third duct 92 by removing the vertical wall 94 from the pair of vertical walls 93. In this way, the filter 98 is detachably provided in the third duct 92.

The filter 98 is configured to allow the air inside the third duct 92 to pass therethrough. Further, the filter 98 is able to capture foreign material, such as ink mist or the like mixed in with the air. A non-woven fabric, glass wool, and rock wool can be used as the filter 98.

As viewed from the positive Z direction, the inner wall surface 78A is positioned further to the outer side in the positive Y direction than the outer wall surface 64A. Similarly, the inner wall surface 79A is positioned further to the outer side in the negative Y direction than the outer wall surface 65A.

As viewed from the positive Z direction, a section corresponding to a gap between the inner wall surface 78A and the outer wall surface 64A, and a section corresponding to a gap between the inner wall surface 79A and the outer wall surface 65A are, respectively, the opening portions 86. The opening portion 86 is an example of a hole portion. Further, the opening portion 86 is also an example of a pressure difference adjustment portion provided on the side portions 61A and 61B of the duct unit 54.

The opening portion 86 adjusts a pressure difference ΔP (=P2−P1) between a pressure P1 inside the duct unit 54 and a pressure P2 inside the exhaust duct 6. In other words, the pressure P2 is the pressure P2 outside the duct unit 54. Note that the pressure difference ΔP is not illustrated. The flow path cross-sectional area of the opening portion 86 is determined by performing a fluid simulation in advance, so as to reduce the pressure difference ΔP.

In the duct unit 54, the amount of air generated by the second fan 52 being rotated, that is, the flow rate of the air, is V2 ($m^3$/sec). With respect to the flow rate V1 of the air in the exhaust device 4 (FIG. 1) described above, the flow rate V2 is set such that V2 is smaller than V1. As a result of the flow rate V1 being generated, the pressure inside the exhaust duct 6 becomes the pressure P1. On the other hand, as a result of the flow rate V2 being generated, the pressure inside the duct unit 54 becomes the pressure P2.

Here, the pressure P1 is less than the pressure P2, that is, the pressure difference ΔP is generated, and thus, in particular, a part of the air flowing through the circulation portion 44 may be discharged to the duct portion 54 regardless of the rotational state of the second fan 52. In this case, if the pressure difference ΔP is not adjusted, the flow of the air may be disturbed in each of the flow paths including the circulation portion 44 inside the printer 10.

In the embodiment, the "adjustment of the pressure difference ΔP" performed by the pressure difference adjustment portion is performed by adjusting the difference between the flow rate V2 of the air in the duct unit 54 and the flow rate V1 of the air in the exhaust duct 6. Specifically, by causing the air to flow from the outside to the inside of the duct unit 54, a flow rate V3 ($m^3$/sec) is generated that is different from the flow rate V2, and the flow rate (V2+V3) is brought closer to the flow rate V1, thereby stabilizing the flow of air inside the circulation portion 44. Note that an "adjusted state of the pressure difference ΔP" refers not only to a state in which the flow rate V3 is changed as appropriate, but also includes a state in which the flow rate V3 has already been adjusted.

Figure 6:
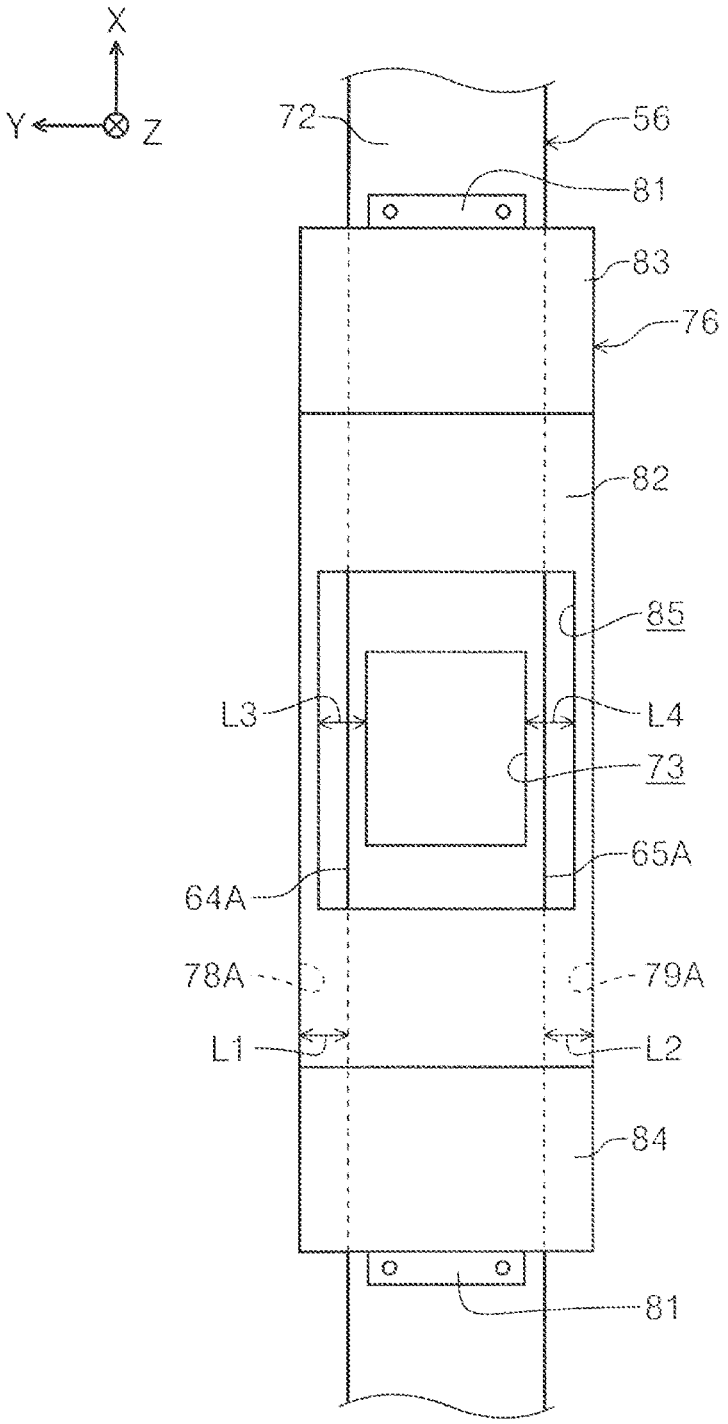
FIG. 6 is a plan view illustrating a relationship between arrangements of the first duct and the second duct according to the first embodiment.

As illustrated in FIG. 6, when the first duct 56 and the second duct 76 are viewed from the negative Z direction, an interval in the Y direction between the outer wall surface 64A and the inner wall surface 78A is L1 (mm), and an interval in the Y direction between the outer wall surface 65A and the inner wall surface 79A is L2 (mm). For example, L1 is equal to L2. Further, when the first duct 56 and the second duct 76 are viewed from the negative Z direction, an interval in the Y direction between the inner surface, in the positive Y direction, of the through hole 73 and the inner surface, in the positive Y direction, of the ventilation hole 85 is L3 (mm), and an interval in the Y direction between the inner surface, in the negative Y direction, of the through hole 58 and the inner surface, in the negative Y direction, of the ventilation hole 85 is L4 (mm). For example, L3 is equal to L4.

Next, actions of the printer 10 according to the first embodiment will be described with reference to FIG. 1 to FIG. 7. The numbers of individual drawings will be omitted below.

The air fed to the inside of the feeding unit 32 by the rotation of the first fan 38 flows toward the space 41. On the other hand, due to the rotation of the second fan 52 in the suction unit 42, air and foreign material, such as ink mist, sucked from the space 41 are discharged to the exhaust duct 6 through the duct unit 54. In this case, a flow rate difference ΔV between the flow rate V1 of the exhaust device 4 and the flow rate V2 of the second fan 52 is generated, but outside air flows from the opening portions 86 into the duct unit 54, that is, the flow rate V3 is added to the flow rate V2, and thus, the flow rate V1 and the flow rate V2+V3 are balanced. In other words, the pressure difference ΔP between the pressure P1 and the pressure P2 is reduced.

As described above, according to the printer 10, when the discharge capacity of the exhaust device 4 is greater than the discharge capacity of the suction unit 42 provided in the printer 10, the pressure P1 inside the duct unit 54 is lower than the pressure outside the duct unit 54, that is, lower than the pressure P2 of the exhaust duct 6. Here, the pressure P1 inside the duct unit 54 is increased by the outside air flowing through the opening portions 86 and into the duct unit 54. In other words, by adjusting the pressure P1 to a value close to the pressure P2, the pressure difference ΔP can be reduced. Thus, even if the discharge capacity of the exhaust device 4 is greater than the discharge capacity of the suction unit 42 provided in the printer 10, the air flow around the recording unit 20 and the air flow inside the suction unit 42 can be prevented from being disturbed by the air discharge by the exhaust device 4.

According to the printer 10, since it is sufficient only to provide the opening portions 86 provided on the side portions 61A and 61B of the duct unit 54, the pressure difference adjustment unit can be realized by a simple configuration, compared to a configuration in which a unit for adjusting the pressure difference ΔP is attached to the duct unit 54.

According to the printer 10, the opening portion 86 that is the gap between the inner wall surface 78A and the outer wall surface 64A, and the opening portion 86 that is the gap between the inner wall surface 79A and the outer wall surface 65A respectively function as the hole portions. Here, the second duct 76 is in a state of covering the first duct 56 from upstream in the positive Z direction, and thus, even if dust falls in the positive Z direction from the ceiling of the installation location of the printer 10, the dust can be prevented from entering the first duct 56 and the second duct 76 through the opening portions 86.

According to the printer 10, compared to a configuration in which the peripheral edge portion of the ventilation hole 73 in the upper wall 72 is along the horizontal direction, the air can easily flow in the direction in which the upper wall 72 is inclined. As a result, the air can be suppressed from stagnating in a part of the suction unit 42.

Note that the air discharged from the suction unit 42 may contain foreign material. Here, according to the printer 10, the filter 98 is detachably provided inside the third duct 92. Thus, foreign material in the air can be recovered by the filter 98, and the filter 98 that is contaminated by the foreign material can be easily replaced.

According to the printer 10, a part of the circulation portion 44 is partitioned by the third side wall 65, in the space between the recording unit 20 and the second fan 52. Here, when a part of the air that has not been sucked into the second fan 52 stagnates and flows toward the recording unit 20, the third side wall 65 restricts the flow of this part of the air. In this way, the air that has flowed downstream from the space 41 between the recording unit 20 and the support face 18 can be suppressed from once more flowing into the space 41 and contaminating the medium M.

According to the printer 10, compared to a configuration in which a part of the third side wall 65 is along the horizontal direction, the air can easily flow in the direction in which the part of the third side wall 65 is inclined. Thus, the air can be prevented from stagnating in a part of the circulation portion 44 of the suction unit 42.

Second Embodiment

Next, as an example of the recording device according to the present disclosure, a printer 100 according to a second embodiment will be described in detail with reference to the appended drawings. Note that the same reference signs are assigned to components common to the first embodiment, and a description thereof will be omitted. Further, even when the dimensions of the members differ from those of the first embodiment, the same reference signs will be assigned where the function is the same, and a description thereof will be omitted.

Figure 8:
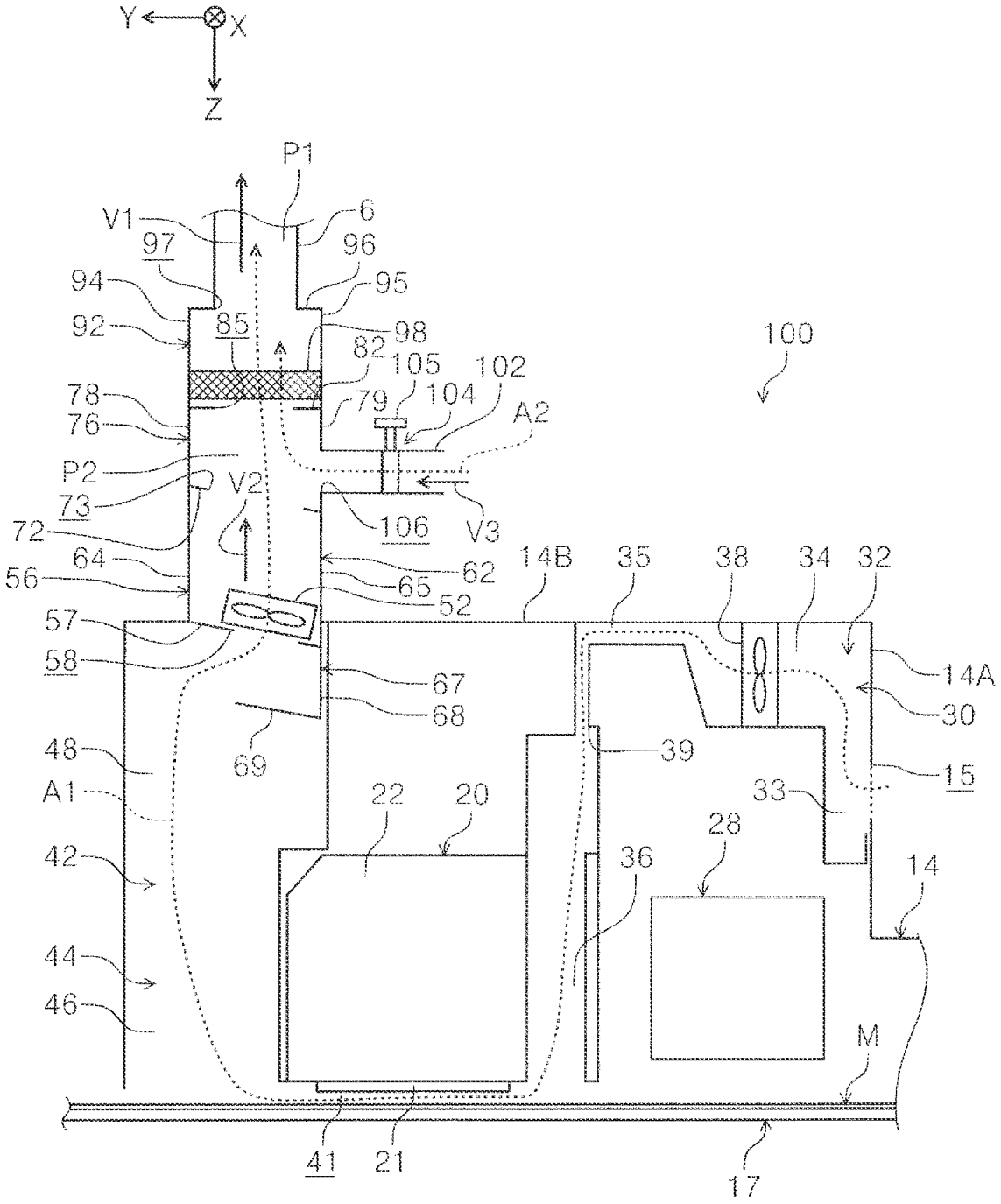
FIG. 8 is a schematic diagram illustrating a state in which a gas flows in a printer according to a second embodiment.

As illustrated in FIG. 8, with respect to the printer 10 (FIG. 7), the printer 100 has a configuration in which a dimension in the Y direction of the second duct 76 and a dimension in the Y direction of the third duct 92 are respectively set to be the same as the dimension in the Y direction of the first duct 56. In other words, in the printer 100, the opening portions 86 (FIG. 7) are not formed. Furthermore, the printer 100 differs from the configuration of the printer 10 in that the printer 100 includes a pipe 102 and a valve 104.

In the second duct 76, no hole portion is formed in the first vertical wall 78. One ventilation hole 106, which penetrates the second vertical wall 79 in the Y direction, is formed in the central portion, in the X direction, of the second vertical wall 79, for example.

The ventilation hole 106 is an example of the hole portion, and is formed in a circular shape as viewed from the Y direction. Note that a "configuration in which a hole portion is provided in a target member" does not only include a configuration in which another member in which the through hole is formed is provided on the target member, but also includes a configuration in which the through hole is formed directly in the target member.

For example, the pipe 102 is formed in a cylindrical shape and extends in the Y direction. An end portion in the positive Y direction of the pipe 102 is coupled to the ventilation hole 106 and an edge portion of the ventilation hole 106. In this way, the pipe 102 can achieve communication between the inside of the duct unit 54 and the outside of the duct unit 54, that is, the outside of the printer 100. In other words, the pipe 102 is configured to allow air to flow from outside the printer 10 into the duct unit 54.

The valve 104 is provided in the pipe 102 and is configured so as to be able to adjust the flow rate of air flowing inside the pipe 102. Specifically, the valve 104 includes a handle 105 operated by a user. Rotation of the handle 105 to one side increases the flow of the air flowing through the interior of the pipe 102. Further, the rotation of the handle 105 to the other side reduces the flow of the air flowing through the interior of the pipe 102. Here, in a state in which the pipe 102 is closed and the exhaust device 4 (FIG. 1) is in operation, the pressure inside at least the second duct 76 is lower than the pressure outside the printer 100. Thus, when the handle 105 is rotated to open the pipe 102, air flows from the outside of the printer 100 into the second duct 76, through the pipe 102.

Note that the valve 104 may be electrically controllable, such as an electromagnetic valve. Further, a first air pressure sensor (not illustrated) is provided outside the second duct 76, and a second air pressure sensor (not illustrated) is provided inside the second duct 76, and a control unit (not illustrated) that controls the valve 104 is provided. According to this configuration, the control unit can control the valve 104 such that a difference between an output from the first air pressure sensor and an output from the second air pressure sensor is equal to or less than a chosen set value, and the trouble of the operation of the user can be eliminated. In this case, as long as the difference in pressure between the pressure outside the second duct 76 and the pressure inside the second duct 76 can be detected, positions where the first air pressure sensor (not illustrated) and the second air pressure sensor (not illustrated) are provided may be adjusted as appropriate.

Next, actions of the printer 100 according to the second embodiment will be described. Note that a description of the same actions and effects as those of the printer 10 will be omitted.

According to the printer 100, by adjusting the flow rate of the air flowing inside the pipe 102 in accordance with a degree of opening of the valve 104, the pressure difference $\Delta P$ between the pressure inside the duct unit 54 and the pressure outside the duct unit 54 can be reduced. In this way, the pressure difference $\Delta P$ can be changed depending on the capacity of the exhaust device 4 in the installation location where the printer 100 is installed.

The printers 10 and 100 according to the first and second embodiments of the present disclosure are based on the configurations described above. However, of course, modifications, omissions, and the like may be made to a partial configuration insofar as they do not depart from the gist of the disclosure of the present application.

Figure 9:
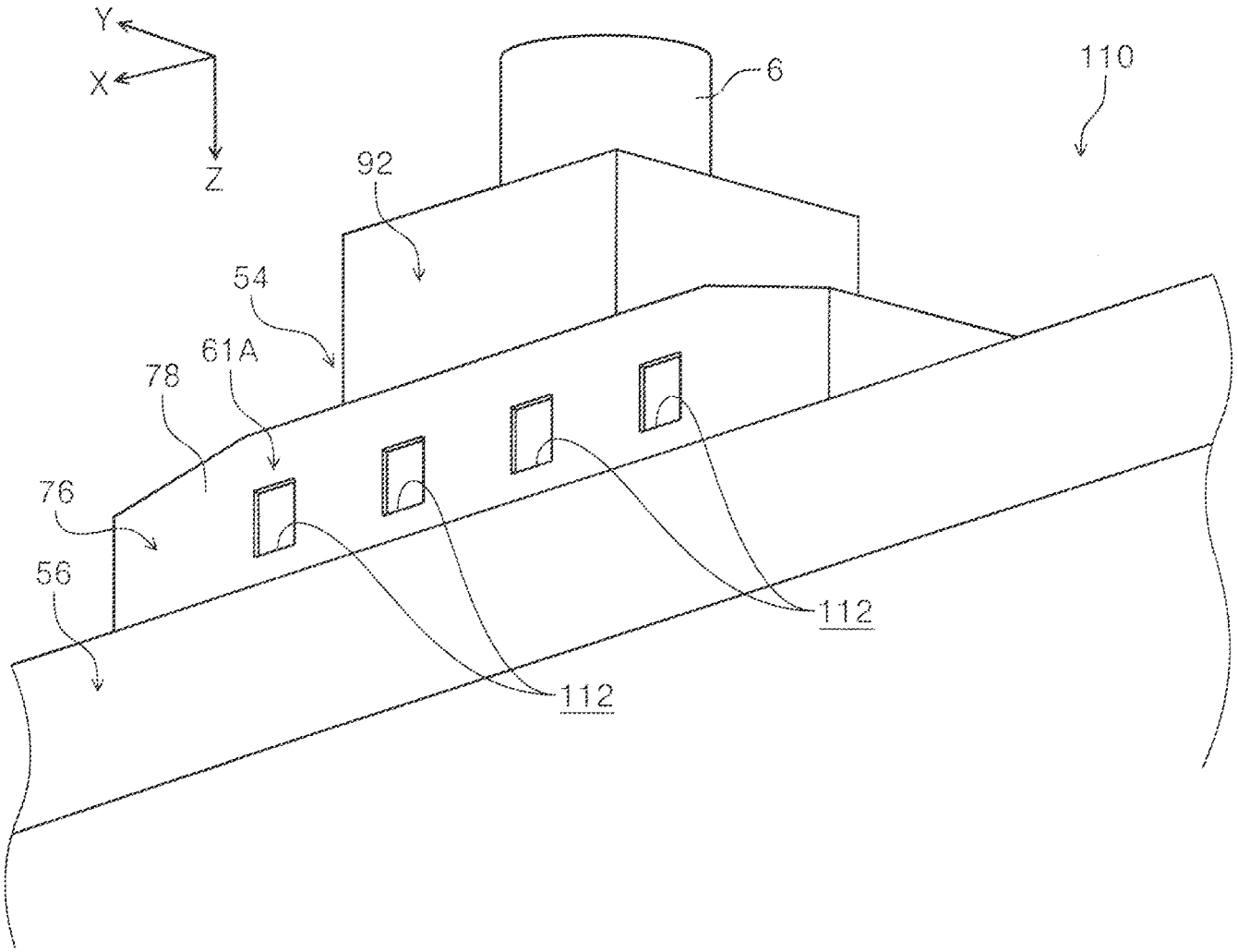
FIG. 9 is a perspective view illustrating a section from the first duct according to the second embodiment to the exhaust duct of the factory.

FIG. 9 illustrates a printer 110 as a modified example of the printer 100 according to the second embodiment. Note that reference will be made to FIG. 8 in relation to the configuration of the printer 100.

In the printer 110, the ventilation hole 106 is not formed, and the printer 110 does not include the pipe 102 and the valve 104. In the printer 110, for example, four ventilation holes 112 are respectively formed in the first vertical wall 78 and the second vertical wall 79. Here, the four ventilation holes 112 in the first vertical wall 78 will be described, and an illustration and description of the four ventilation holes 112 in the second vertical wall 79 will be omitted.

The four ventilation holes 112 are an example of the hole portion, and penetrate the first vertical wall 78 in the Y direction. Further, the four ventilation holes 112 are formed in the first vertical wall 78 at intervals in the X direction. For example, the shape of the ventilation hole 112 is a square shape. Further, the flow path cross-sectional area of the ventilation hole 112 is determined by performing a fluid simulation so that the pressure difference ΔP described above is reduced.

According to the printer 110, since it is sufficient that the four ventilation holes 112 only be formed in the side portions 61A and 61B, respectively, of the duct unit 54, the pressure difference adjustment unit can be realized by a simple configuration, compared to a configuration in which a unit for adjusting the pressure difference ΔP is attached to the duct unit 54.

In the printers 10 and 100, the pressure difference adjustment unit may be configured using a louver. Further, an adjustment structure may be used in which the pressure difference adjustment unit is configured by a plurality of opening portions and lid portions capable of opening and closing the opening portions, and in which the flow rate difference ΔV between the flow rate V1 and the flow rate V2, or the pressure difference ΔP is reduced by causing some of the opening portions to be closed and causing the remaining opening portions to be open.

The pressure difference adjustment unit may be formed in the first duct 56.

The exhaust duct 6 may be coupled to the second duct 76 without providing the third duct 92. The first duct 56 and the second duct 76, the second duct 76 and the third duct 92, or the first duct 56, the second duct 76, and the third duct 92 may be configured as one integrated member.

The opening portion 86 is not limited to being formed over the entire X direction of the second duct 76, and may be formed at a portion, in the X direction, of an end portion in the positive Z direction of the second duct 76.

The upper wall 72 may extend along the horizontal direction.

The filter 98 is not limited to being provided in the third duct 92, and may be provided in the first duct 56 or the second duct 76. In other words, the position of the filter 98 can be freely set as long as the filter 98 is downstream of the second fan 52.

The lower portion 67 of the third side wall 65 need not necessarily extend into the interior of the circulation portion 44. In other words, a portion of the circulation portion 44 need not necessarily be partitioned using the third side wall 65.

In place of the inclined wall 69, a wall portion extending along the horizontal direction may be provided.

Examples of the medium M include a film, in addition to the fabric and the sheet. A method for aligning the transport of the medium M may be either of a center resist method using a center position in the X direction as a reference, or a side resist method using a position of one of the ends in the X direction as the reference.

The recording unit 20 is not limited to performing the recording in a serial manner as in the recording head 21, and may perform the recording in a line head manner. Further, as the recording unit 20, a fixing mechanism for fixing a toner, including a color material, to the medium M may be employed. In other words, the printers 10, 100 and 110 may employ an electrophotographic method.

The support unit is not limited to a belt, and may be a pallet that supports the medium M and is moved in the transport direction.

A known diaphragm pump may be employed instead of the first fan 38 and the second fan 52.

A transport belt functioning as the support unit is not limited to the glue belt 17, and belts using various adsorption power inducing mechanisms can be used, such as an electrostatic attraction method using electrostatic forces generated by applying a voltage, a vacuum suction method using a compressor, an intermolecular force method using an adhesive, and the like.

Further, the transport belt is not limited to the endless belt that is caused to move in the revolving manner. For example, the transport belt may be a flat belt (a belt having an end) that is taken up by a roller as the roller rotates. When the belt having the end is employed, it is sufficient that the cleaning unit 26 be configured to clean the outermost surface of a portion, of the belt having the end, that is taken up by the roller.

What is claimed is:

1. A recording device comprising:

a recording unit configured to perform recording on a medium transported in a transport direction;

a support unit facing the recording unit, and including a support face configured to support the medium;

a feeding unit provided upstream of the recording unit in the transport direction, and configured to feed gas toward the support face;

a suction unit provided downstream of the recording unit in the transport direction, and configured to suck gas flowing from the support face; and a duct unit through which gas discharged from the suction unit flows, wherein a pressure difference adjustment unit is provided in the duct unit, the pressure difference adjustment unit being configured to adjust a pressure difference between a pressure inside the duct unit and a pressure outside the duct unit, the pressure difference adjustment unit is a hole portion provided at a side portion of the duct unit, the duct unit includes:

a first duct into which gas flows from the suction unit, and a second duct positioned upstream of the first duct in a gravitational direction and coupled to the first duct, and as seen from the gravitational direction, an inner wall surface of the second duct is positioned outside an outer wall surface of the first duct.

2. The recording device according to claim 1, wherein the pressure difference adjustment unit includes a pipe coupled to the hole portion, the pipe being configured to achieve communication between the inside of the duct unit and the outside of the duct unit, and a valve provided at the pipe, the valve being configured to adjust a flow rate of gas flowing inside the pipe.

3. The recording device according to claim 1, wherein as seen from the gravitational direction, the hole portion is a gap between the inner wall surface and the outer wall surface.

4. The recording device according to claim 3, wherein an upper wall, to which the second duct is attached, is provided at an upstream end portion, in the gravitational direction, of the first duct, a ventilation hole is formed at the upper wall, the ventilation hole extending through the upper wall in the gravitational direction, and gas being flowable through the ventilation hole, and a peripheral edge portion of the ventilation hole at the upper wall is inclined with respect to a horizontal direction orthogonal to the gravitational direction.

5. The recording device according to claim 3, comprising:

a third duct positioned upstream, in the gravitational direction, of the second duct and coupled to the second duct, wherein a filter is detachably provided at the third duct, gas inside the third duct being permeable through the filter.

6. The recording device according to claim 1, wherein:

the suction unit includes a circulation portion extending from a position between the recording unit and the support face to the duct unit, gas being flowable inside the circulation portion, and a suction fan provided inside the duct unit and configured to suck gas, and the duct unit includes a partition wall extending to the interior of the circulation portion and configured to partition a part of the circulation portion between the recording unit and the suction fan.

7. The recording device according to claim 6, wherein a part of the partition wall is inclined with respect to a horizontal direction orthogonal to a gravitational direction.

* * * * *